US009506691B2

(12) United States Patent
Orr et al.

(10) Patent No.: US 9,506,691 B2
(45) Date of Patent: Nov. 29, 2016

(54) CLOSED LOOP DRYING SYSTEM AND METHOD

(75) Inventors: Jonathan N. Orr, Sugar Land, TX (US); Thomas M. Anderson, Naples, FL (US); Charles Michael Wanstrom, Maplewood, MN (US)

(73) Assignee: Schwing Bioset, Inc., Somerset, WI (US)

( * ) Notice: Subject to any disclaimer, the term of this patent is extended or adjusted under 35 U.S.C. 154(b) by 1150 days.

(21) Appl. No.: 12/736,871

(22) PCT Filed: Aug. 12, 2009

(86) PCT No.: PCT/US2009/004639

§ 371 (c)(1),
(2), (4) Date: Feb. 23, 2011

(87) PCT Pub. No.: WO2010/019246

PCT Pub. Date: Feb. 18, 2010

(65) Prior Publication Data

US 2011/0173836 A1 Jul. 21, 2011

Related U.S. Application Data

(60) Provisional application No. 61/188,736, filed on Aug. 12, 2008.

(51) Int. Cl.
*F26B 3/02* (2006.01)
*F26B 21/08* (2006.01)
(Continued)

(52) U.S. Cl.
CPC ..... *F26B 3/084* (2013.01); *F26B 21/04* (2013.01); *F26B 21/086* (2013.01); *F26B 21/14* (2013.01)

(58) Field of Classification Search
CPC ..... F23J 2217/101; F26B 3/08; F26B 3/084; F26B 17/00
See application file for complete search history.

(56) References Cited

U.S. PATENT DOCUMENTS 2,256,882 A * 9/1941 Sebald ..... 165/72
2,723,000 A * 11/1955 Fritz et al. ..... 95/109
(Continued)

FOREIGN PATENT DOCUMENTS

CN 1065817 A 11/1992

OTHER PUBLICATIONS

The International Search Report and Written Opinion in counterpart Foreign Application No. PCT/2009/004639 filed Aug. 12, 2009.

*Primary Examiner* — Jiping Lu
(74) *Attorney, Agent, or Firm* — Kinney & Lange, P.A.

(57) ABSTRACT

A drying system includes a fluidized bed dryer and fluidizing gas loop. The system is a closed loop so that fluidizing gas used to dry particulate matter can be reconditioned and recycled to fluidize and dry additional particulate matter. The fluidizing gas is reconditioned by removing fine particulates and water vapor. The drying system includes oxygen control features to prevent oxygen from entering the system. A method for drying particulate matter includes fluidizing the particulate matter in a dryer with a fluidizing gas, heating the particulate matter to remove water, removing water vapor and fluidizing gas from the dryer, removing fines and water vapor from the fluidizing gas, recirculating the fluidizing gas to the dryer to fluidize additional particulate matter and removing dried particulate matter from the dryer. A modular drying system reduces the amount of construction necessary at the installation site.

21 Claims, 10 Drawing Sheets

(51) Int. Cl.

| | |
|---|---|
| ***F26B 25/14*** | (2006.01) |
| ***F26B 25/20*** | (2006.01) |
| ***F26B 3/084*** | (2006.01) |
| ***F26B 21/04*** | (2006.01) |
| ***F26B 21/14*** | (2006.01) |

(56) References Cited

U.S. PATENT DOCUMENTS

| | | | | | |
|---|---|---|---|---|---|
| 3,360,867 | A | * | 1/1968 | Sanderson | 34/362 |
| 3,367,043 | A | * | 2/1968 | Torigian | 34/193 |
| 3,376,678 | A | * | 4/1968 | Thygeson, Sr. | 52/211 |
| 4,236,318 | A | * | 12/1980 | Heard et al. | 34/361 |
| 4,244,698 | A | * | 1/1981 | King et al. | 23/313 FB |
| 4,292,742 | A | | 10/1981 | Ekberg | |
| 4,338,998 | A | * | 7/1982 | Goloff | 165/165 |
| 4,372,751 | A | * | 2/1983 | Chapman et al. | 44/629 |
| 4,419,215 | A | | 12/1983 | Voetter et al. | |
| 4,495,710 | A | * | 1/1985 | Ottoson | 34/371 |
| 4,567,674 | A | | 2/1986 | Strohmeyer, Jr. | |
| 4,601,113 | A | | 7/1986 | Draper et al. | |
| 4,860,536 | A | * | 8/1989 | Brannstrom | 60/39.464 |
| 5,046,265 | A | | 9/1991 | Kalb | |
| 5,111,596 | A | | 5/1992 | Laurenty | |
| 5,208,998 | A | * | 5/1993 | Oyler, Jr. | F26B 5/065 159/4.01 |
| 5,283,959 | A | | 2/1994 | Nagayoshi et al. | |
| 5,373,648 | A | | 12/1994 | Wolf | |
| 5,546,875 | A | | 8/1996 | Selle et al. | |
| 5,830,247 | A | | 11/1998 | Dunlop | |
| 7,540,384 | B2 | | 6/2009 | Ness et al. | |
| 2006/0107587 | A1 | | 5/2006 | Bullinger et al. | |
| 2008/0147241 | A1 | * | 6/2008 | Tsangaris et al. | 700/273 |
| 2008/0201980 | A1 | * | 8/2008 | Bullinger et al. | 34/493 |
| 2009/0031934 | A1 | * | 2/2009 | Ganga et al. | 110/346 |

* cited by examiner

CLOSED LOOP DRYING SYSTEM AND METHOD

CROSS-REFERENCE TO RELATED APPLICATION(S)

This application is a U.S. National Phase filing of International Application No. PCT/US2009/004639, entitled "CLOSED LOOP DRYING SYSTEM AND METHOD," filed on Aug. 12, 2009, which claims priority from U.S. Provisional Application Ser. No. 61/188,736, entitled "CLOSED LOOP COAL DRYING APPARATUS AND METHOD," filed on Aug. 12, 2008.

BACKGROUND

A large portion of the world's electric power is generated from burning fossil fuels such as coal. The four primary types of coal (ranked from high to low) are anthracite, bituminous, sub-bituminous and lignite. Higher-rank coals typically contain less moisture and fewer pollutants than lower-rank coals. Coal is typically dried to enhance its rank and heating value (kJ, BTU per pound). In addition to enhancing rank and heating values, drying coal provides additional benefits. For example, once moisture has been removed after drying, coal is lighter and can be transported more easily and with less expense. Thus, coal drying is an important step in electric power generation.

Various coal drying methods and systems have been used in the past several decades including rotary kilns, cascading whirling bed dryers, elongated slot dryers, hopper dryers, traveling bed dryers and vibrating fluidized bed dryers. Many of these methods and systems require high temperatures and pressures. Because large amounts of energy are needed to reach these high temperatures and pressures, drying lower-rank coals with these methods can be economically impractical. Thus, efforts have been made to develop coal drying methods using lower temperatures and pressures. Many low temperature methods utilize fluidized bed technology, but are able to dry coal only to a limited extent. Subsequent high temperature steps are sometimes used to further dry coal processed at low temperatures. One issue encountered with fluidized bed drying of coal is the production of fines that become entrained in the fluidizing medium. In an environment where oxygen, and in some cases the ignition energy, is readily available, these fines can spontaneously combust. Thus, these drying methods typically use inert fluidizing gases such as nitrogen, carbon dioxide and steam to provide an environment with limited oxygen in order to prevent combustion.

Efforts have also been made to increase the efficiency of coal drying systems by using waste heat streams as heat sources. Waste heat streams include coke cooling gas, flue gas, stack gas, and steam condensate from power generation turbines. One or more waste heat streams can be used alone to provide heat to coal drying systems or in conjunction with primary heat sources, typically provided by the combustion of fossil fuels.

While past innovation has provided advancement of coal drying techniques, further improvements in coal drying efficiency and cost are desired. Even small improvements in coal drying efficiency can have huge, beneficial effects. A five percent increase in efficiency can mean tens of millions of dollars in savings per year for an average size power plant.

SUMMARY

A method for drying particulate matter includes delivering particulate matter to a dryer, circulating a fluidizing gas through the dryer, heating the particulate matter in the dryer to remove water from the particulate matter, and removing dried particulate matter from the dryer. The method also includes removing water vapor and fluidizing gas from the dryer, removing fine particulates and water vapor from the fluidizing gas, and redirecting the fluidizing gas to the dryer after removing water vapor from the fluidizing gas.

A coal drying system includes a fluidized bed dryer and a fluidizing gas loop in fluid communication with the fluidized bed dryer. The fluidized bed dryer has a coal inlet for delivering coal to the dryer, a gas inlet for receiving a fluidizing gas, a heat exchanger for heating coal and fluidizing gas, a gas outlet for removing water vapor and fluidizing gas, and a coal outlet for removing dried coal from the dryer. The coal inlet and coal outlet receive an inert gas during coal delivery and removal, respectively, to prevent ingress of oxygen into the dryer. The fluidizing gas loop includes a heat exchanger for heating the fluidizing gas, a bypass for directing fluidizing gas to an upper portion of the dryer, a dust collector for removing fine particulates from the fluidizing gas, a condenser for removing moisture from the fluidizing gas, a fan for circulating the fluidizing gas through the fluidizing gas loop, a vent outlet for removing gas from the loop and a makeup gas inlet for adding fluidizing gas to the loop. The fan has a seal and an inert gas is directed at the seal to prevent ingress of oxygen into the fluidizing gas loop.

A modular fluidized bed dryer includes first and second dryer modules. Each dryer module has a plenum section with a gas inlet, a gas distribution plate section, a middle housing section with a heat exchanger, and an upper housing section with a particulate matter inlet and a gas outlet. The first dryer module and the second dryer module are welded together so that the plenum sections of the first and second dryer modules, the middle housing sections of the first and second dryer modules, the upper housing sections of the first and second dryer modules and the gas distribution plate sections of the first and second dryer modules are connected to form the modular fluidized bed dryer.

DETAILED DESCRIPTION

Figure 1:
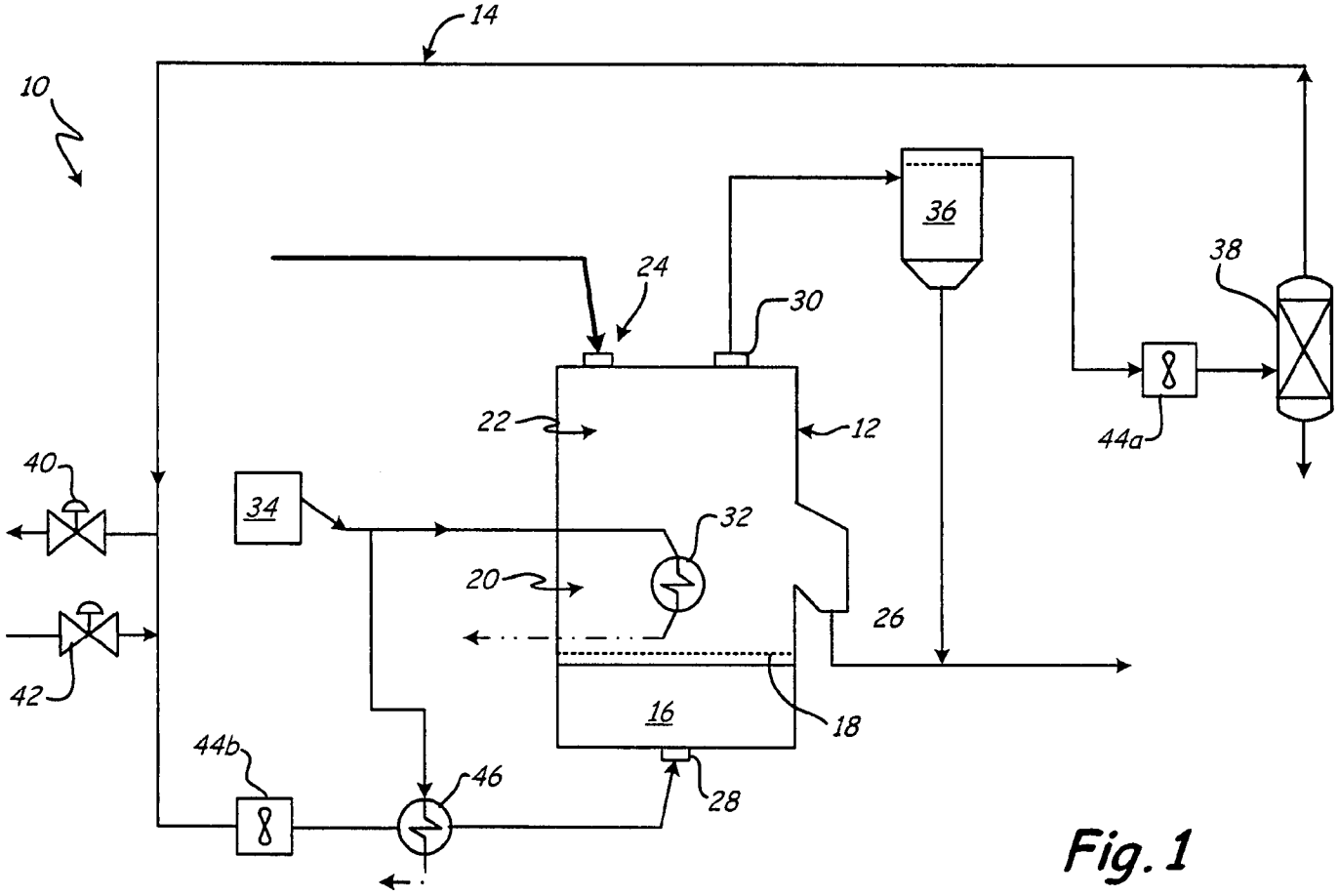
FIG. 1 is a schematic diagram illustrating a closed loop coal drying system.

The present invention provides an improved method and system for drying particulate matter, including coal. While various types of particulate matter can be dried using the present invention, the embodiments described herein refer specifically to the drying of coal. Drying coal presents certain challenges (i.e. spontaneous combustion). However, the methods and systems described for drying coal can also be used for drying other types of particulate matter. Though the following embodiments explicitly refer to coal drying, it should be understood that the method and system of the present invention is not limited solely to coal drying, but includes other types of particulate matter (e.g., biomass, peat, solid waste, etc.) as well.

In one embodiment, a method for drying coal utilizes a closed loop system employing waste heat sources and an inert fluidizing gas. By drying particulate matter using a fluidized bed with an inert fluidizing gas, the level of oxygen present in the drying system can be tightly controlled to prevent combustion within the system. In a closed loop arrangement, only the inert fluidizing gas is delivered to the system to dry the particulate matter. Oxygen is generally kept out of the system. Small amounts of oxygen can sometimes enter when coal is added to or removed from the system and during the drying process when the coal physically breaks down and releases oxygen trapped within it. Additional control over the oxygen level within the system is maintained by a series of mechanisms that prevent ingress of oxygen into the system. Small amounts of inert gas are applied to the devices and sealing surfaces of the system where oxygen has the potential to enter (e.g., fan shaft seals, rotary airlocks, etc.). By utilizing these mechanisms, the oxygen level within the system can be controlled more tightly than in previous systems. In some cases, incorporating the small amounts of inert gas at various sites in the system can provide and maintain the proper level of inert fluidizing gas within the system to allow for steady state operation. In other cases, only small amounts of "makeup" gas need to be added to the system.

In one embodiment, the inert fluidizing gas is recycled and used again for fluidizing the particulate matter. In order to recycle the inert fluidizing gas, the moisture released from the coal and taken up by the fluidizing gas must be removed from the fluidizing gas before it is reintroduced to the coal. One way of removing moisture from the fluidizing gas is to condense the water vapor carried by the fluidizing gas so that the water vapor and the gas can be separated. This condensing step allows the system to recycle the fluidizing gas for additional use and operate with increased efficiency and lower costs. In systems where the fluidizing gas is not recycled, large amounts of the fluidizing gas need to be purchased or generated. Purchasing or generating large amounts of inert gas is costly. Recycling the fluidizing gas allows the system to operate at lower cost levels. Additionally, the recycled fluidizing gas still has an elevated temperature just before it returns to the fluidized drying bed. As its temperature is above ambient, less energy is needed to reheat the fluidizing gas to the necessary drying temperature. Thus, recycling the fluidizing gas reduces costs related to both the purchase or generation of fluidizing gas and the energy needed to heat the fluidizing gas.

In one embodiment, the drying method and system utilize relatively low drying temperatures within the fluidized bed dryer. By using relatively low drying temperatures, a wider range of heat sources can be used to dry coal according to the present invention, not just those heat sources providing high levels of thermal energy. When combined with the method and system of the present invention, the low bed temperature provides for reduced potential of in-bed combustion of coal during drying as well as lower levels of gasification. A low temperature drying bed also provides a more efficient drying process.

In addition to the lower thermal energy needed to dry coal, the drying method and system of the present invention allow the use of smaller and more efficient equipment for subsequent processing steps. For example, in one embodiment the drying method and system significantly reduces the particle size of friable coal such as lignite. This particle size reduction can translate into power and cost savings during subsequent processing steps. Because the particle size of the coal has been reduced, smaller secondary grinding and milling equipment can be used. Smaller secondary equipment can cost less to manufacture and requires less power to operate and grind or mill the dried coal. The amount of power can be reduced by sixty to ninety percent when friable coal is dried according to the present invention before grinding or milling.

FIG. 1 illustrates one embodiment of closed loop coal drying system 10. Coal drying system 10 includes fluidized bed dryer 12 and fluidizing gas loop 14. Fluidized bed dryer 12 can have any of a number of different configurations. For example, fluidized bed dryer 12 can be configured to provide a stationary fluidized bed or a vibrating fluidized bed. Fluidized bed dryer can have a generally rectangular footprint or a circular or elliptical design and footprint.

Fluidized bed dryer 12 can be generally divided into three separate sections. Plenum section 16 is generally located at the bottom of fluidized bed dryer 12. Fluidizing gas enters fluidized bed dryer 12 at plenum section 16. Plenum section 16 typically does not contain coal during the drying process. Distribution plate 18 separates plenum section 16 from middle housing section 20. Once established, the fluidized bed occupies a substantial portion of middle housing section 20. Middle housing section 20 can also contain heat exchangers or heating coils that transfer heat to the fluidized coal during the drying process. Upper housing section 22 is generally located at the top of fluidized bed dryer 12. The fluidized bed also occupies a substantial portion of upper housing section 22. Fluidizing gas typically exits fluidized bed dryer 12 from upper housing section 22.

Various types of coal can be dried using the method and system of the present invention. Low-rank coal, such as lignite, and higher-rank coals, such as bituminous and subbituminous coal, and other moisture-laden coals can be effectively dried. The surface moisture of "wet" coal introduced into fluidized bed dryer 12 can vary depending on the type of coal. Wet coal that can be dried using the method and system of the present invention typically has an incoming surface moisture between about 0.5% and about 10%. Wet coal with a surface moisture greater than 10% can still be dried according to the present invention. Wet coal can also contain internal moisture in addition to surface moisture. Besides variances in surface moisture, the particle size of the wet coal can vary greatly. Depending on the particle size of the incoming wet coal, the temperature within fluidized bed dryer 12 and the flow of fluidizing gas through fluidized bed dryer 12 are adjusted to create and maintain a fluidized bed of coal. Coal with particle sizes (diameters) ranging from 5 microns to greater than 1 inch can be dried using the method and system of the present invention. The maximum particle size of coal that can be dried according to the present invention is determined by the overall system's ability to transport large coal particles within fluidized bed dryer 12.

Wet coal is introduced into fluidized bed dryer 12 at coal inlet 24. A fluidized bed of coal is created within fluidized bed dryer 12 as described below. The fluidized coal releases moisture. Dried coal exits fluidized bed dryer 12 at coal outlet 26. Outlet 26 can be an overflow weir, an underflow device such as a rotary airlock or horizontal screw conveyor located at the end of the bed, or a combination of these devices. Dried coal removed from fluidized bed dryer 12 at coal outlet 26 can go through additional processes, such as milling or grinding steps or mineral oil coating, before the coal is burned to produce energy.

Fluidizing gas enters fluidized bed dryer 12 at gas inlet 28. Gas inlet 28 is generally located at or near the bottom of fluidized bed dryer 12 so that fluidizing gas can flow through dryer 12 and create a fluidized bed of coal during the drying process. Various fluidizing gases can be used according to the present invention. Typically, an inert gas is chosen. Suitable inert fluidizing gases include nitrogen, carbon dioxide and low-oxygen flue gas. In coal drying system 10 illustrated in FIG. 1, the fluidizing gas enters fluidized bed dryer 12 at plenum section 16 via gas inlet 28.

Gas exits fluidized bed dryer 12 at gas outlet 30. Gas outlet 30 is generally located in upper housing section 22, above the fluidized bed. Fluidizing gas generally flows from gas inlet 28 through plenum section 16, middle housing section 20 and upper housing section 22 to gas outlet 30. As the fluidizing gas flows through middle housing section 20 and upper housing section 22, the gas mixes with coal in these sections to create a fluidized coal bed. Moisture from the outer surface and internal core of the coal evaporates in the fluidized bed. As the fluidizing gas passes through the fluidized bed, the gas picks up and absorbs the moisture released from the coal. The gas can also carry very fine coal particles (fines) either present with the wet coal stream as it enters the dryer or released from the coal during drying. When the gas exits fluidized bed dryer 12 at gas outlet 30, the gas contains more moisture and fines than the gas contained when it entered fluidized bed dryer 12 at gas inlet 28. Gas exiting fluidized bed dryer 12 at gas outlet 30 flows into fluidizing gas loop 14.

One or more bed heat exchangers 32 can be located in middle housing section 20 of fluidized bed dryer 12. Bed heat exchanger 32 can have a tubular configuration with tubes either in horizontal or vertical orientation (relative to the bed of fluidizing coal particles), or consist of plate coils. In both cases, the tubes or coils are normally connected to common inlet and outlet supply headers. Other suitable heat exchanger configurations are also possible. Bed heat exchanger 32 provides heat to the fluidized coal in middle housing section 20 via conductive heat transfer with coal particles in direct contact with the heated surface, or via convective means with heat transfer to the fluidizing gas. Heating the fluidized coal increases the rate at which moisture contained within the coal vaporizes. Typical fluidized bed temperatures are generally between about 15° C. (60° F.) and about 120° C. (250° F.). However, bed temperatures as high as about 200° C. (400° F.) can be used according to the present invention. Bed heat exchanger 32 is optional. In some embodiments, the fluidizing gas contains enough thermal energy to heat the fluidized coal and bed heat exchanger 32 can be omitted.

Thermal energy is provided to bed heat exchanger 32 by one or more heat sources 34. Heat source 34 can be any primary or secondary heat source. Heat source 34 generally provides heat between about 38° C. (100° F.) and about 315° C. (600° F.). Heat provided by primary heat sources includes heat generated by burning fossil fuels such as oil, natural gas or coal. Secondary heat sources include waste heat streams from other locations in a power plant. Waste heat streams include heated cooling water, condensate, saturated and/or superheated steam and heat transfer fluids heated by other power plant activities (e.g., cooling coke, etc.). Thermal energy is provided by heat source 34 to bed heat exchanger 32, which heats the fluidized coal. The cooled residual heat stream leaving bed heat exchanger 32 is removed from the fluidized bed dryer 12 and disposed of or reused for other purposes within the power plant.

Fluidizing gas loop 14 includes dust collector 36, condenser 38, gas vent valve 40, gas inlet valve 42 and one or more fans 44. Fluidizing gas loop 14 can also optionally include gas loop heat exchanger 46, which can be heated from the same heat sources as bed heat exchanger 32 or another heat source.

Gas exits fluidized bed dryer 12 at gas outlet 30 and enters fluidizing gas loop 14. The gas exiting fluidized bed dryer 12 contains fines and moisture. Coal drying system 10 illustrated in FIG. 1 utilizes a closed loop, and the fluidizing gas is reconditioned and recycled so that it can be used for fluidizing additional coal. In order to make the gas leaving gas outlet 30 suitable for return to fluidized bed dryer 12 and additional fluidizing, the gas must be reconditioned. Reconditioning the gas requires removing fine particulate matter (fines) from the gas and removing moisture from the gas. Depending on the characteristics of the coal being dried and the stage of the drying process (e.g., virtually all of the coal in fluidized bed dryer 12 has been dried), one or both of the reconditioning steps may be required.

Dust collector 36 removes fines from the gas after the gas has exited fluidized bed dryer 12. The fines removed from the gas can be routed to and combined with the dried coal exiting fluidized bed dryer 12 through coal outlet 26, returned to dryer 12 for reprocessing or kept as a separate stream for other uses or disposition. Because the amount of fines is relatively small compared to the amount of dried coal removed via coal outlet 26, any moisture carried by the fines is relatively insignificant when the fines are combined with the dried coal. The partially reconditioned gas (without the fines) continues through fluidizing gas loop 14.

Dust collector 36 can take various forms. Suitable dust collectors 36 include, but are not limited to, cyclones, multiclones, baghouses, electrostatic precipitators and wet scrubbing units. Baghouses include mechanical-shaker baghouses, reverse-air baghouses and reverse-jet baghouses. Wet scrubbing units include venturi scrubbers, countercurrent spray towers, co-current packed towers and countercurrent packed towers. Dust collector 36 can be a single unit or a combination of units functioning cooperatively to remove fines from the gas in order to recondition it.

Condenser 38 removes moisture from the gas after the fines have been removed. Condenser 38 is typically a surface condenser, although other condensers and shell and tube heat exchangers that convert water vapor into water can also be used. Condenser 38 removes at least a substantial portion of water vapor from the gas. Under normal conditions, the amount of moisture condensed is equivalent to the amount of moisture evaporated from the coal in dryer 12. The dried gas exits condenser 38 and continues through fluidizing gas loop 14. The condensed water vapor exits condenser 38 as liquid water separately from the gas. In some cases the liquid water can be reused for additional purposes such as water cooling or provision of makeup or removed from the power plant. An alternate configuration of condenser 38 allows for isolation of the cooling media from the gas in loop 14 and employs the use of a cross-cooling heat exchanger between the water used within the condenser itself and the cooling source. In such a case, the cooling source can include chilled water, refrigerant and other media, as well as cooling water. This latter configuration prevents or eliminates the potential for contamination of the cooling media itself with dust or other undesirable constituents which could be captured in the condensing step.

After leaving condenser 38, the gas continues through fluidizing gas loop 14. Fluidizing gas loop 14 includes gas vent valve 40 and gas inlet valve 42 to control the pressure of coal drying system 10. Gas vent valve 40 allows gas to leave coal drying system 10. Coal drying system 10 generally operates with a pressure in upper housing section 22 of dryer 12 at or near atmospheric pressures (760 mm Hg), usually between about 755 mm Hg and about 775 mm Hg. Gas vent valve 40 allows gas to exit fluidizing gas loop 14 and coal drying system 10 in order to maintain necessary or preferred operating pressures. When pressures in fluidized bed dryer 12 or other areas of coal drying system 10 become too high, gas is bled out of the system through gas vent valve 40. Gas inlet valve 42 allows fluidizing gas to enter coal drying system 10. When pressures in fluidized bed dryer 12 or other areas of coal drying system 10 become too low, "makeup" gas is added to the system through gas inlet valve 42. Gas vent valve 40 and gas inlet valve 42 can operate independently of one another, but normally operate in a coordinated fashion and in conjunction with the objective of maintaining reduced oxygen levels in coal drying system 10.

Fluidizing gas loop 14 includes one or more fans 44 to circulate gas through fluidizing gas loop 14. Fans 44 are typically located in areas of fluidizing gas loop 14 where additional gas velocity and pressure is needed to maintain overall system flow (e.g., before heat exchangers). As shown in FIG. 1, fan 44*a* is located before condenser 38 and fan 44*b* is located before gas loop heat exchanger 46. This location can be preferred or beneficial depending on the design operating pressure range for condenser 38. Fan 44*a* can also be located in series with fan 44*b* near gas loop heat exchanger 46, to take full advantage of the heat evolved during the mechanical compression of the fluidizing gas which occurs in both fans 44*a* and 44*b*. The needed gas pressure and flow can also be provided with a single fan at the fan 44*b* location Gas loop heat exchanger 46 is used to heat or pre-heat the new or recycled fluidizing gas before the gas enters fluidized bed dryer 12. Gas loop heat exchanger 46 is heated by one or more primary or secondary heat sources. Heat source 34 can provide thermal energy to gas loop heat exchanger 46 just as it provides thermal energy to bed heat exchanger 32. Alternatively, gas loop heat exchanger 46 can receive thermal energy from a different heat source. Other heat sources for heat exchanger 46 can include the previously mentioned primary or secondary heat sources and the returning media from heat source 34 after its use in bed heat exchanger 32. Gas loop heat exchanger 46 is optional depending on the type of fluidizing gas selected and the operating temperatures of fluidized bed dryer 12. For example, when the fluidizing gas is flue gas, the flue gas may enter the system at a high enough temperature that does not require further elevation before the gas fluidizes the coal in fluidized bed dryer 12. Additionally, where temperatures within fluidized bed dryer 12 are low, bed heat exchanger 32 can sometimes provide enough thermal energy so that the fluidizing gas does not need to be preheated before it reaches fluidized bed dryer 12. Operation of coal drying system 10 can include the addition of heat to the system by bed heat exchanger 32, gas loop heat exchanger 46 or both bed heat exchanger 32 and gas loop heat exchanger 46.

Figure 2:
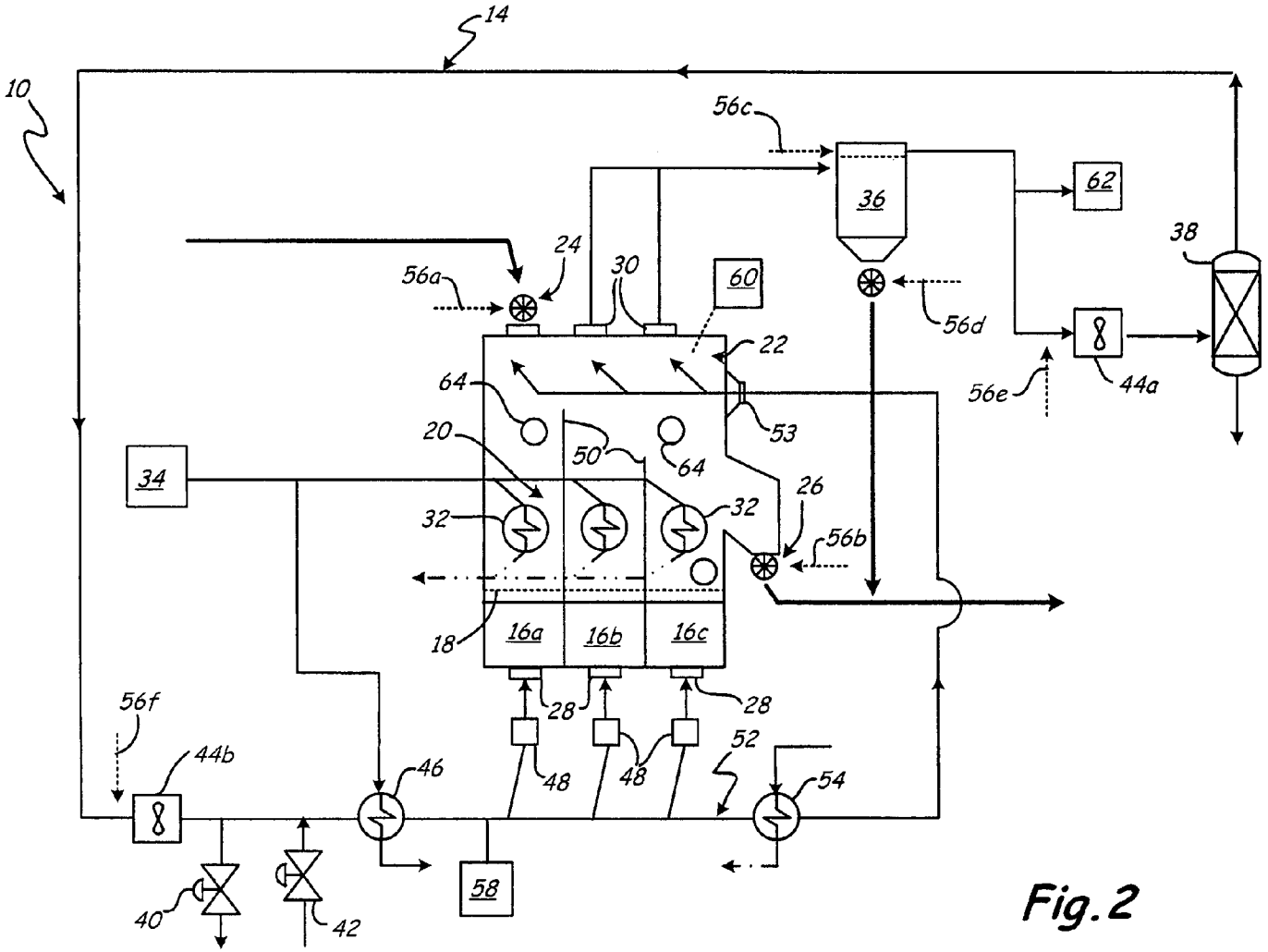
FIG. 2 is a schematic diagram illustrating a closed loop coal drying system with mechanisms to prevent ingress of oxygen into the system.

FIG. 1 illustrates the basic concept of closed loop coal drying system 10. FIG. 2 illustrates another embodiment of coal drying system 10 with additional features. These additional features improve the overall performance of coal drying system 10 and limit the ingress of oxygen into coal drying system 10. As discussed above, fine coal particles can spontaneously combust at relatively low temperatures when oxygen is present at ordinary atmospheric levels (~21% v/v). In order to prevent this combustion hazard during drying the amount of oxygen present in fluidized bed dryer 12 must be controlled. Typically, gases in fluidized bed dryer 12 contain no more than about nine or ten percent oxygen (v/v), which is normally well below the lower explosion limit (LEL) for fines from particulate such as any of the different types of coal. The risk of spontaneous combustion is significantly reduced when oxygen is kept at or below this level. It is possible to control the oxygen level to well below the mentioned range as well. Coal drying system 10 as shown in FIG. 2 allows stringent control of the oxygen level by both its closed loop configuration and additional features that prevent oxygen from entering coal drying system 10.

As shown in FIG. 2, coal drying system 10 includes multiple fluidizing gas inlets 28 and plenum sections 16*a*, 16*b* and 16*c*. Plenum section 16 can contain baffles or be compartmentalized in order to affect the flow of fluidizing gas through the different areas of the fluidized bed dryer 12, thus creating different zones or stages within the dryer. FIG. 2 illustrates fluidized bed dryer 12 with compartmentalized plenum sections 16*a*, 16*b* and 16*c* with each section containing one gas inlet 28. Compartmentalized plenum section 16 allows higher or lower fluidizing gas flow in and through compartments 16*a*, 16*b* and 16*c*. Before the fluidizing gas enters plenum section 16 at gas inlets 28, the fluidizing gas passes through dampers 48. Dampers 48 control and regulate the flow of fluidizing gas into each plenum section (16*a*, 16*b* and 16*c*). Dampers 48 provide velocity control of the fluidizing gas so that fluidized bed dryer 12 can operate more effectively or have different drying stages to increase system efficiency. For example, to maintain an optimal fluidized bed, the velocity of fluidizing gas in the area where wet coal is introduced (coal inlet 24) is typically higher in order for the wet coal to be fluidized. In these cases, fluidizing gas flow through plenum section 16*a* will be higher than fluidizing gas flow through plenum section 16*c* because the coal above plenum section 16*a* is larger, wetter and heavier than the lighter, typically smaller and drier coal above plenum section 16*c*. A higher fluidizing gas velocity is needed to fluidize larger, wetter coal particles.

In addition to dampers 48, distribution plate 18 can also be used to modify the flow of fluidizing gas in fluidized bed dryer 12. Distribution plate 18 can utilize directional flow to facilitate the removal of oversized or large particles so that they do not affect the fluidizing or drying processes. A variety of plate designs are possible which direct gases into the lower boundary of the fluidizing layer of particles. Plates with nozzles, angular perforations, or slots and assembled upper pieces can effectively create a directional flow component with the introduction of fluidizing gas. The directional gas flow component can be arranged to direct larger sized coal particles towards a discharge area within or toward coal outlet 26 (the discharge end of dryer 12). The directional flow configuration can also reduce the potential for backsieving of fluidized coal particles into the compartments of plenum section 16 of fluidized bed dryer 12. This directional plate design can also serve to separate oversized material if the flow pattern is arranged in such a fashion to direct flow to a separate oversized material discharge mechanism (e.g., an internal screw or rotary airlock discharge device).

Fluidized bed dryer 12 optionally contains baffles 50 to enhance the drying process. Baffles 50 are used to reduce backmixing effects and narrow residence time distribution for particles within fluidized bed dryer 12. Baffles 50 ensure uniform treatment of coal particles before they are discharged. Baffles 50 serve to minimize the cross-flow of particles back and forth between respective zones in dryer 12, and on balance allow more of the particles to migrate as intended in the dryer, from the point of feed (coal inlet 24) to the discharge area (coal outlet 26). In one embodiment, baffles 50 are arranged with minimal open areas near the bottoms of baffles 50 to allow the intended directional migration of oversized coal particles without obstruction. Baffles can be designed to extend above the fluidized layer in such a fashion that particle eruptions (as would occur with the emergence of a large gas bubble from the top of the fluidizing layer of particles) are contained within the same zone or area of the bed from which they originate. The extension of the baffle can even be arranged to meet the top of upper housing section 22 of dryer 12, allowing for the separate collection and processing of the gas exiting fluidized bed dryer 12 from gas outlets 30, which can be beneficial in some cases.

Fluidized bed dryer 12 can also be arranged in subdivisions or stages. Staged treatments allow different areas of the fluidized bed to focus on particular treatments. For instance, one stage can accelerate classification of the coal, while a second stage accelerates particle size reduction of the coal, and a third stage cools the coal before it is removed from fluidized bed dryer 12. Stages and subdivisions offer the opportunity to provide improved process control.

As a result of the fluidizing gas flow direction and the moisture released from the coal during the drying process, upper housing section 22 of fluidized bed dryer 12 can contain high levels of water vapor during operation. If left unchecked, this water vapor can condense on relatively cooler surfaces within upper housing section 22 and cause undesired accumulations of fines on the upper surfaces of fluidized bed dryer 12, or even in undesirable locations within fluidizing gas loop 14 or dust collector 36 (e.g., the surfaces of bags, thus causing a fouling or caking effect in a baghouse, if used). To prevent this from occurring, an additional supply of heated inert gas is delivered to upper housing section 22. The heated inert gas can be the same gas as the fluidizing gas or any other heated inert gas. This gas is used to suppress the absolute and relative humidity of gas exiting fluidized bed dryer 12 through gas outlets 30, and thus prevent or at least minimize the condensation effects.

Bypass gas loop 52 is an additional element of fluidizing gas loop 14. While some of the fluidizing gas enters fluidized bed dryer 12 through gas inlets 28, some of the fluidizing gas bypasses gas inlets 28 and continues to bypass gas loop 52. Typically, between about zero percent and about twenty percent (v/v) of the fluidizing gas bypasses gas inlets 28 and proceeds to bypass gas loop 52. Optionally, bypass gas loop 52 can include bypass heat exchanger 54, which heats the fluidizing gas to an even higher temperature than that provided by gas loop heat exchanger 46. The addition of exchanger 54 can be beneficial as the volume of bypass gas can be reduced, creating savings in terms of reduced gas handling equipment sizing and overall operating cost. The bypass fluidizing gas enters fluidized bed dryer 12 in upper housing section 22. Because this gas is generally warmer than the fluidizing gas already present in fluidized bed dryer 12, the relative humidity in upper housing section 22 is reduced. This decrease in relative humidity prevents condensation of water vapor on surfaces within upper housing section 22 and in downstream equipment such as dust collector 36, and allows more water vapor to exit fluidized bed dryer 12 at gas outlets 30. By eliminating or reducing condensation within fluidized bed dryer 12 and downstream areas such as dust collector 36, consequences such as fouling and scaling caused by condensed water exposure can be reduced, if not entirely eliminated.

Coal drying system 10 illustrated in FIG. 2 also includes a number of oxygen control features. Control of oxygen within coal drying system 10 is critically important to ensure safe operation of the system. Coal drying system 10 operates in a closed loop fashion. The system is designed to be gastight to the largest extent possible. The closed loop design prevents oxygen from entering the system via most of the system components. Oxygen does not enter the system through heat exchangers 32 and 46, fluidizing gas inlets 28 or outlets 30 or condenser 38. However, without additional features, small amounts of environmental air (and hence, oxygen) can enter the system as coal is introduced to fluidized bed dryer 12 or entrained within the coal, and may also be able to penetrate various mechanical seals. Oxygen control features 56 operate together to eliminate or reduce ingress of environmental air into coal drying system 10. As shown in FIG. 2, oxygen control features 56 are associated with coal inlet 24 (56*a*), coal outlet 26 (56*b*), dust collector 36 (56*c* and 56*d*), fan 44*a* (56*e*) and fan 44*b* (56*f*). Those skilled in the art will recognize that additional oxygen control features 56 can be used for other system components that introduce coal or particulate matter or contain mechanical seals.

Oxygen control feature 56*a* is associated with coal inlet 24. One example of coal inlet 24 with oxygen control feature 56*a* is a rotary airlock as shown in FIG. 2. A rotary airlock allows coal to enter fluidized bed dryer 12 while limiting the amount of atmospheric oxygen that enters fluidized bed dryer 12 along with the coal. Coal enters a pocket of the rotary airlock along with environmental air at a first position. The pocket with the coal and air rotates to a second position where it is isolated from both additional coal and environmental air and fluidized bed dryer 12. While in the second position, the pocket is purged with an inert gas (sweep gas) to remove the air from the environment that entered the pocket with the coal and to replace it with the inert gas. The majority of environmental air is swept away from the airlock before it has a chance to pass into fluidized bed dryer 12. The pocket with the coal and inert gas rotates to a third position where the coal drops from the pocket into fluidized bed dryer 12 or secondary hopper. The inert gas present in the pocket enters fluidized bed dryer 12 without increasing the oxygen content of the dryer. The inert gas used for the purge can be of the same type that is used to fluidize the coal or any other inert gas. A suitably designed closed screw conveyor or set of screw conveyors can be substituted for 56*a* with proper design to minimize ingress of air.

Oxygen control feature 56*b* is associated with coal outlet 26. Examples of coal outlets 26 include, but are not limited to, rotary airlocks, screw conveyors and overflow weirs. FIG. 2 illustrates coal outlet 26 of the rotary airlock variety. A rotary airlock allows coal to exit fluidized bed dryer 12 while limiting the amount of atmospheric oxygen that enters fluidized bed dryer 12 as the coal exits. The mechanism works in a similar way to that described above. However, at coal outlet 26, once an airlock pocket dumps the coal removed from fluidized bed dryer 12, environmental air enters the pocket and rotates to a second position. The environmental air is purged from the pocket with inert gas at the second position so that when it rotates to a third position to pick up additional dried coal, environmental air does not enter fluidized bed dryer 12. The new supply of dried coal displaces inert gas rather than environmental air as it enters the pocket. The operation is slightly different, but the principle is the same as described above with respect to coal inlet 24. Screw conveyors can also operate similarly. Screw conveyor screw pockets can be purged with inert gas before they rotate to allow displacement of environmental air.

Multiple discharge points can be arranged for discharging the dried coal. In most cases, depending on the intended purpose, it can be beneficial to separate the dried coal from the fluidized coal prior to reaching the 56*b* rotary airlock device. Usually, a combination of underflow devices (e.g., actuated underflow gates or flaps, rotary screw conveyors, underflow rotary airlocks) and an overflow mechanism are employed. The overflow can consist of a simple weir, over which the fluidizing solids at the discharge area of the dryer are intended to flow over. The weir can be arranged in an adjustable fashion (operating in a fashion like an elongated horizontal ball valve), a bolted plate with pre-drilled bolting holes for relocating the plate to a higher or lower position, or similar. The underflow arrangement can be operated in an intermittent fashion simply to clear oversized particles or on a more continuous basis to take more of the normal dryer throughput. In the latter case, the device can be operated with speed control to maintain a constant fluidized bed level based on the measured differential pressure of the fluidized layer (an indication of the theoretical height of the layer). In this case, the overflow arrangement serves more to prevent overfilling of the dryer. The discharging solids from the overflow weir can be handled separately from the underflow arrangement (e.g., in the case where it is desirable to handle oversized material in a different fashion downstream such as reprocessing, recrushing, etc.), or combined into one stream and discharged from a common device such as rotary airlock coal outlet 26.

Oxygen control features 56*c* and 56*d* are associated with dust collector 36. Where dust collector 36 is a baghouse, oxygen control feature 56*c* can be a baghouse pulse jet system. A baghouse pulse jet system delivers pulsed jets of inert gas through the baghouse filter in the opposite direction of fluidizing gas flow. The pulsed jets prevent the baghouse filter from becoming clogged with fines. Inert gas is used instead of environmental air so that oxygen is not blown back into the system by the fluidizing gas. Reverse flow baghouses can simply use the inert gas already present in the gas loop (after it has been discharged from the baghouse) for cake control on the bags. Oxygen control feature 56*d* can be associated with the outlet of dust collector 36 in a fashion similar to that of oxygen control feature 56*b* and coal outlet 26. Fines from dust collector 36 exit through a rotary airlock. Pocket purges prevent environmental air from entering dust collector 36 and entering fluidizing gas loop 14.

Oxygen control features 56*e* and 56*f* are generally associated with mechanical seals. Fan shaft seals for fans 44*a* and 44*b* can allow minute amounts of environmental air to enter coal drying system 10. To prevent these seals from allowing environmental air to slip through, tiny pulsed jets or a light stream of inert gas are applied to the seal area. Pulsed jets of inert gas can be suitable for components that do not operate continuously (e.g., turn on and off during the drying process). Persistent light streams of inert gas can be suitable for components that run continuously. Like the purge (sweep) gas described above, the inert gas for oxygen control features 56*e* and 56*f* can also be of the same type as the fluidizing gas. The pulsed jets and streams of inert gas sweep environmental air away from areas in which the air might enter coal drying system 10.

The various oxygen control features 56 prevent oxygen from entering coal drying system 10 and/or introduce additional inert gas into the system. An additional benefit of oxygen control features 56 is that the additional inert gas can replace gas lost from system 10 during processing. Some of the inert fluidizing gas is lost to the environment at coal outlet 26. The inert gas leaves fluidized bed dryer 12 along with the coal and is not easily recoverable. In other systems, this lost gas would typically be replaced by "makeup" gas delivered to the system through gas inlet valve 42. However, because inert gas is already being added to coal drying system 10 as part of the oxygen control element, the amount of makeup gas entering through gas inlet valve 42 can be reduced or even eliminated. In essence, coal drying system 10 utilizes some of the makeup gas to also prevent ingress of oxygen into the system. In a demonstration facility processing up to 7300 kg of wet feed per hour, makeup gas quantities were between about 45 kg per hour and about 200 kg per hour (depending on the targeted oxygen level in fluidizing gas loop 14, among other conditions).

As shown in FIG. 2, fluidizing gas loop 14 also contains oxygen sensor system 58. Oxygen sensor system 58 monitors the oxygen and carbon monoxide content of the gas flowing through fluidizing gas loop 14. When oxygen sensor system 58 detects too much oxygen, gas inlet valve 42 opens to allow additional inert fluidizing gas to enter fluidized bed dryer 12. Carbon monoxide (CO) is an indication of in-bed combustion during the drying process. Carbon monoxide can form when carbon dioxide ($CO_2$), oxygen or water react with carbon. When oxygen sensor system 58 detects too much CO, the temperature of the fluidizing gas (via gas loop heat exchanger 46) or the fluidized bed (via bed heat exchanger 32) can be reduced to lessen or prevent in-bed combustion. Other measures can be taken in conjunction with these steps to accelerate oxygen removal from coal drying system 10, such as the opening of valve 40. Valve 42 can also be opened to introduce additional inert fluidizing gas and facilitate a reduction in combustion potential within fluidized bed dryer 12 (as indicated by CO formation).

When combined with the closed loop design, oxygen control features 56 allow tight control of the oxygen content within coal drying system 10. While the system needs to have less than about nine or ten percent oxygen (v/v) in order to operate safely, coal drying system 10 can control the level of oxygen present in the system to virtually any desired value. Levels of six percent oxygen (v/v), three percent oxygen (v/v) and lower are possible for coal drying system 10 illustrated in FIG. 2.

Additional features in coal drying system 10 include pressure sensor 60, moisture sensor 62 and sight glasses 64. Pressure sensor 60 measures the pressure within fluidized bed dryer 12. Pressure sensor 60 communicates with a controller (not shown) that operates gas vent valve 40 and gas inlet valve 42. Gas vent valve 40 bleeds gas out of coal drying system 10 when the pressure is too high and gas inlet valve 42 allows new fluidizing gas to enter coal drying system 10 when the pressure is too low. Moisture sensor 62 measures the water vapor content of the gas exiting fluidized bed dryer 12. Moisture sensor 62 communicates with a controller (not shown) that operates valves that control the amount of fluidizing gas entering or bypassing gas inlets 28. When the water vapor content of the gas leaving fluidized bed dryer 12 is too high, additional fluidizing gas is delivered to bypass gas loop 52 to enter fluidized bed dryer 12 at upper housing section 22 to reduce the relative humidity within the dryer. When the water vapor content of the gas leaving fluidized bed dryer 12 is low, a smaller amount of fluidizing gas is delivered to bypass gas loop 52 and more gas is used to fluidize the coal in the dryer. This allows coal drying system 10 to maintain the desired level of absolute or relative humidity of the gas exiting the dryer and delivered to dust collector 36.

In some embodiments, the walls of fluidized bed dryer 12 contain one or more sight glasses 64. Sight glasses 64 facilitate monitoring of the fluidization quality in different sections of fluidized bed dryer 12. An operator can observe various locations or stages within fluidized bed dryer 12 to determine whether any temperature or gas velocity or distribution adjustments need to be made. Due to the coal fluidization within fluidized bed dryer 12, inside surfaces of sight glasses 64 may become coated with coal particles, especially in high-moisture release or coal loading areas, obscuring an operator's view of the fluidized bed. The inner surfaces of sight glasses 64 can be equipped with wipers or inert gas nozzles to physically remove attached coal particles which make viewing difficult.

Coal drying system 10 can also be configured to allow for clean-in-place (CIP) operation. CIP allows for quick cleaning of coal drying system 10 without disassembly or other invasive cleaning procedures. Middle housing section 20 and upper housing section 22 of fluidized bed dryer 12 can be emptied of coal using pulses of dry gas, such as the fluidizing gas, which direct the dryer contents towards coal outlet 26. Plenum section 16 can also be cleaned using gas pulses, directing any fine particles that manage to pass through distribution plate 18 to an outlet within plenum section 16. Dust collector 36 can also be emptied using pulses of dried gas. Cleaning of fluidized bed dryer 12 and dust collector 36 can be facilitated by recirculating a cleaning gas through each. Suitable cleaning gases include nitrogen, carbon dioxide and, as mentioned, the inert fluidizing gas itself (if taken from a suitable high pressure location within fluidizing gas loop 14 or compressed beyond normal operating pressures).

Figure 3:
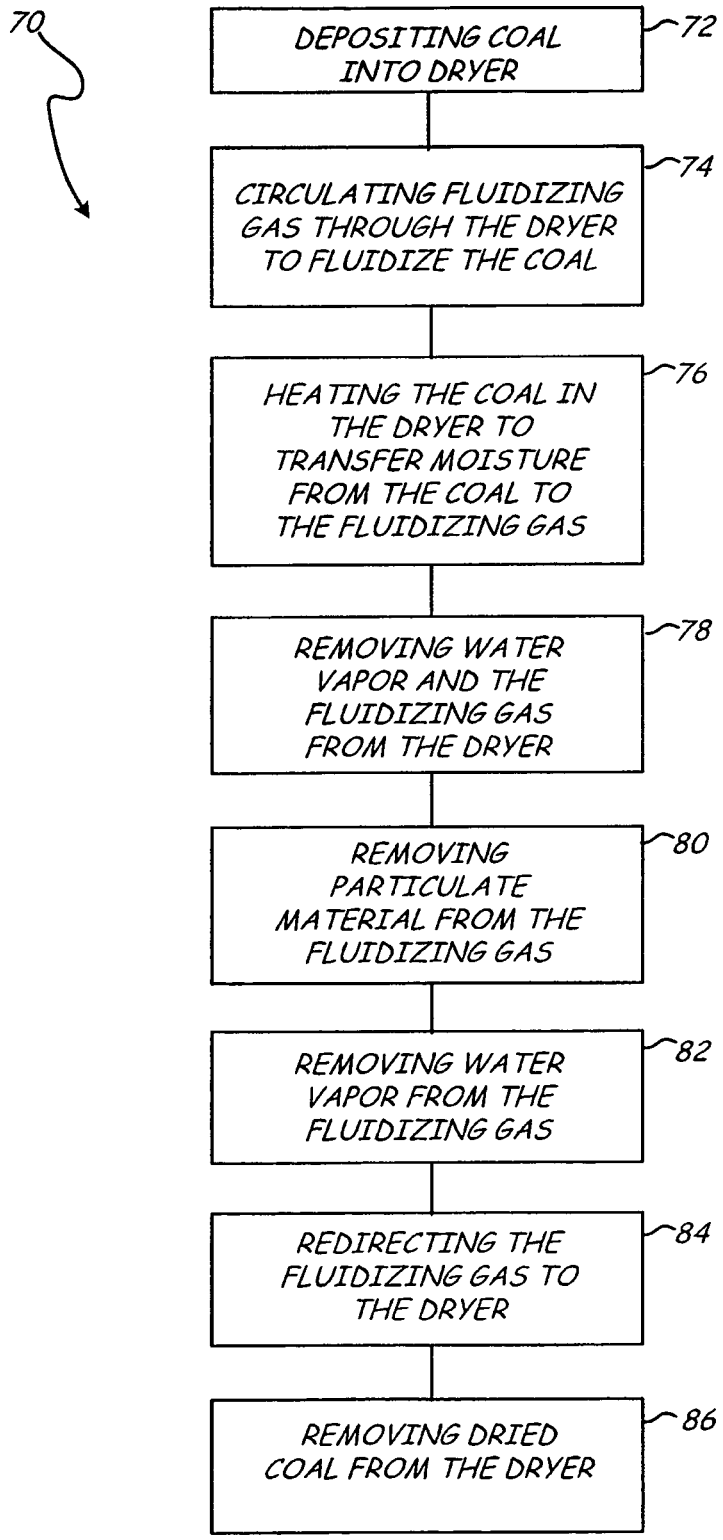
FIG. 3 is a flow diagram for a method for drying coal using a closed loop coal drying system.

Coal drying system 10 illustrated in FIG. 2 and described above provides a method of drying coal using a closed loop drying system. FIG. 3 illustrates a flow diagram of a method of drying coal according to the present invention. Coal drying method 70 includes depositing coal into a dryer (step 72), circulating a fluidizing gas through the dryer to fluidized the coal (step 74), heating the coal in the dryer to transfer moisture from the coal to the fluidizing gas (step 76), removing water vapor and fluidizing gas from the dryer (step 78), removing particulate material from the fluidizing gas (step 80), removing water vapor from the fluidizing gas (step 82), redirecting the fluidizing gas to the dryer after removing water vapor and particulate material from the fluidizing gas (step 84) and removing dried coal from the dryer (step 86).

As described above, coal is deposited into fluidized bed dryer 12 via coal inlet 24. Fluidizing gas enters fluidized bed dryer 12 through gas inlet 28. The fluidizing gas is delivered to fluidize the coal inside fluidized bed dryer 12. The coal is heated in fluidized bed dryer 12 by the fluidizing gas (preheated by gas loop heat exchanger 46), bed heat exchanger 32 or both. As a result of the heat applied to the fluidized coal, moisture present in the coal vaporizes. The fluidizing gas carries the water vapor out of the fluidized bed dryer 12 at gas outlet 30. Particulate material (fines) is removed from the fluidizing gas by dust collector 36. Water vapor is removed from the fluidizing gas by condenser 38. Once particulate material and water vapor have been removed from the fluidizing gas, the fluidizing gas is redirected to the dryer to fluidize additional coal. Dried coal is removed from fluidized bed dryer 12 via coal outlet 26.

Utilizing coal drying system 10 in conjunction with method 70 dries the coal added to the system. In addition to drying the coal, coal drying system 10 and method 70 reduces the particle size of the coal added to fluidized bed dryer 12. Many coals, in particular low-rank coals like lignite, fracture during the drying process. By drying the coal according to method 70, the average particle size of the coal can be reduced by up to sixty percent. This reduction in particle size provides additional benefits. First, reducing the particle size of the coal can reduce the dead space between adjacent coal particles thereby reducing the volume needed for storage. Second, dried coal is sometimes milled or ground following method 70 and before combustion. Reducing the particle size of the coal in turn reduces the amount of energy needed for secondary milling and grinding steps. Reducing the particle size of the coal also reduces the size requirements of the milling and grinding equipment. Reductions in energy consumption upwards of seventy-five percent or greater can be observed for subsequent milling or grinding.

According to the system and method of the present invention, coal can be dried with a thermal energy input of between about 2740 kilojoules (kJ) and about 3260 kJ per kilogram of water evaporated (~1180-1400 BTU per pound of water evaporated). The amount of thermal energy expended to dry the coal depends upon a variety of factors including the initial moisture content of the wet coal, the temperature of the wet coal fed into fluidized bed dryer 12, ambient conditions (atmospheric temperature and humidity), available utility conditions (heat sources and electrical power available for operating the system) and the desired moisture of the dried coal. Higher thermal energy inputs are observed for outlet moistures below about fifteen percent (w/w) (including internal moisture).

A significant amount of the energy consumed by coal drying system 10 is used to operate condensing step 82. Removing water vapor from the fluidizing gas can require between about 80% and about 110% of the combined amount of thermal energy used by fluidized bed dryer 12 and/or gas loop heat exchanger 46. The amount of energy required for condensing step 82 depends upon a variety of factors including the temperature of the wet coal fed to the dryer, the moisture levels of coal entering and exiting the dryer, available utility conditions, the amount of heat introduced to the system from system components (fans, etc.), heat losses and the amount and condition of fluidizing gas exiting the system.

While condensing step 82 consumes a relatively significant amount of energy, recycling the fluidizing gas in a closed loop offers huge cost savings in other areas. The fluidizing gas used in coal drying system 10, can flow through the system once, be partially recycled or nearly completely recycled (assuming losses only for gas that leaves the system with the dried coal). Generating or purchasing fluidizing gas for coal drying system 10 can be expensive. Recycling the fluidizing gas by removing water vapor (condensing step 82) after it exits fluidized bed dryer 12 reduces the need for generating or purchasing additional gas as the reconditioned and recycled fluidizing gas can be used to dry additional coal. Overall, utilizing a closed loop system with recycled fluidizing gas can provide an efficiency increase over existing coal drying systems and methods on the order of five to ten percent. This increase in efficiency can translate into tens of millions of dollars in savings per year for an average size power plant.

Figure 4:
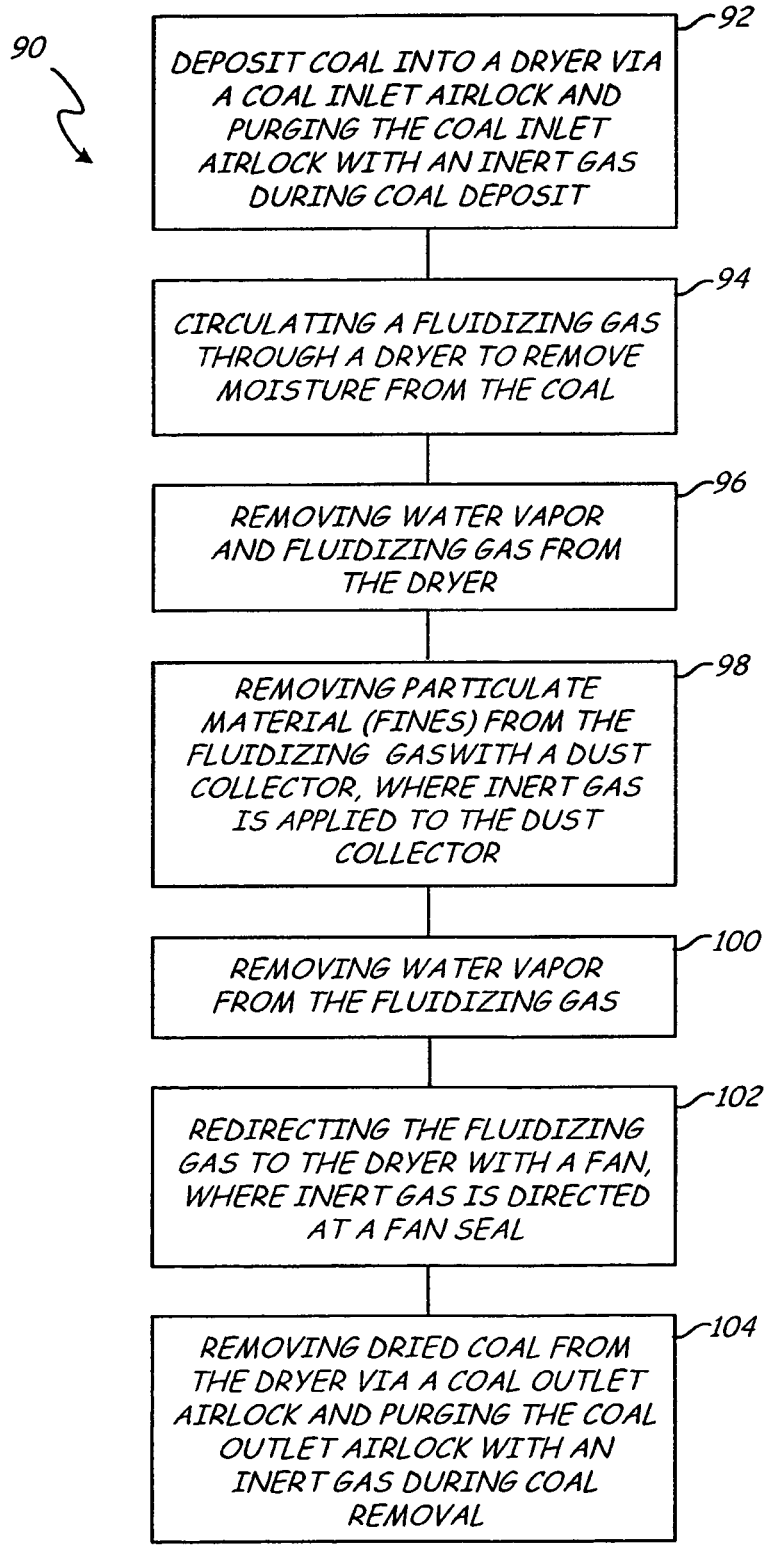
FIG. 4 is a flow diagram for a method for controlling oxygen content in a closed loop coal drying system.

FIG. 4 illustrates a flow diagram of a method of controlling oxygen content in a closed loop coal drying system. Method 90 includes depositing coal into a dryer via a coal inlet airlock and purging the coal inlet airlock with an inert gas during coal deposit to prevent ingress of oxygen (step 92). Step 94 includes circulating a fluidizing gas through the dryer to remove moisture from the coal. Step 96 includes removing water vapor and fluidizing gas from the dryer. Step 98 includes removing particulate material (fines) from the fluidizing gas with a dust collector, wherein inert gas is applied to the dust collector to prevent ingress of oxygen. Step 100 includes removing water vapor from the fluidizing gas. Step 102 includes redirecting the fluidizing gas to the dryer with a fan having at least one seal after removing water vapor from the fluidizing gas, wherein inert gas is directed at the at least one seal to prevent ingress of oxygen. Step 104 includes removing dried coal from the dryer via a coal outlet airlock and purging the coal outlet airlock with an inert gas during coal removal to prevent ingress of oxygen.

As described above, coal is deposited into fluidized bed dryer 12 via coal inlet 24 (rotary airlock). Oxygen control feature 56*a* purges coal inlet 24 with an inert gas to prevent oxygen from entering fluidized bed dryer 12. Fluidizing gas enters fluidized bed dryer 12 through gas inlet 28 and circulates to remove moisture from the coal inside fluidized bed dryer 12. As a result of the heat applied to the fluidized coal, moisture present in the coal vaporizes. The fluidizing gas carries the water vapor out of the fluidized bed dryer 12 at gas outlet 30. Particulate material (fines) is removed from the fluidizing gas by dust collector 36. An inert gas is applied to dust collector 36 to remove fines from dust collector filters (oxygen control feature 56*c*) and/or to prevent oxygen from entering dust collector 36 during removal of the particulate material (oxygen control feature 56*d*). Water vapor is removed from the fluidizing gas by condenser 38. Once particulate material and water vapor have been removed from the fluidizing gas, the fluidizing gas is redirected to the dryer to fluidize additional coal. Fans 44 redirect the reconditioned fluidizing gas back to fluidized bed dryer 12. Fans 44 contain a seal and oxygen control feature 56. Oxygen control feature 56*e* or 56*f* directs inert gas towards the fan shaft seals to prevent ingress of oxygen into coal drying system 10. Dried coal is removed from fluidized bed dryer 12 via coal outlet 26 (rotary airlock). Oxygen control feature 56*b* purges coal outlet 26 with an inert gas to prevent oxygen from entering fluidized bed dryer 12. The closed loop design and oxygen control features 56 allow the tight control of the oxygen content within coal drying system 10.

In many embodiments, fluidized bed dryer 12 has significant size with large dimensions and a large footprint. In one contemplated installation, a footprint of approximately 8.2 meters by 17.7 meters was determined to be appropriate for processing about 100 metric tons of wet coal per hour. Due to the large size of fluidized bed dryers 12, they are typically either constructed or assembled at the power plant or other manufacturing site in which they will operate. Often, one or more large crews of skilled construction engineers are required to assemble dryer 12 once it has been designed. In addition to the engineers, large quantities of all of the various construction materials, tools and other equipment must to be sent to the power plant site, taking up space. An additional feature of coal drying system 10 is the modular capability of fluidized bed dryer 12. Fluidized bed dryer 12 can be manufactured as separate modules at a manufacturing worksite, delivered to the installation site and then more easily assembled into a modular fluidized bed dryer 12 at the installation site. Dryer modules can be erected by skilled craftsmen at a permanent manufacturing site with dedicated tools and equipment, better ensuring a high-quality and consistent product. Dryer modules can be shipped individually assembled or in a relatively small number of "pieces" by regular transportation means to the installation site for final assembly. This modular aspect provides for reduced assembly time at the installation site and allows fabrication of identical or nearly identical modules that can be welded together to form fluidized bed dryer 12.

Figure 5A:
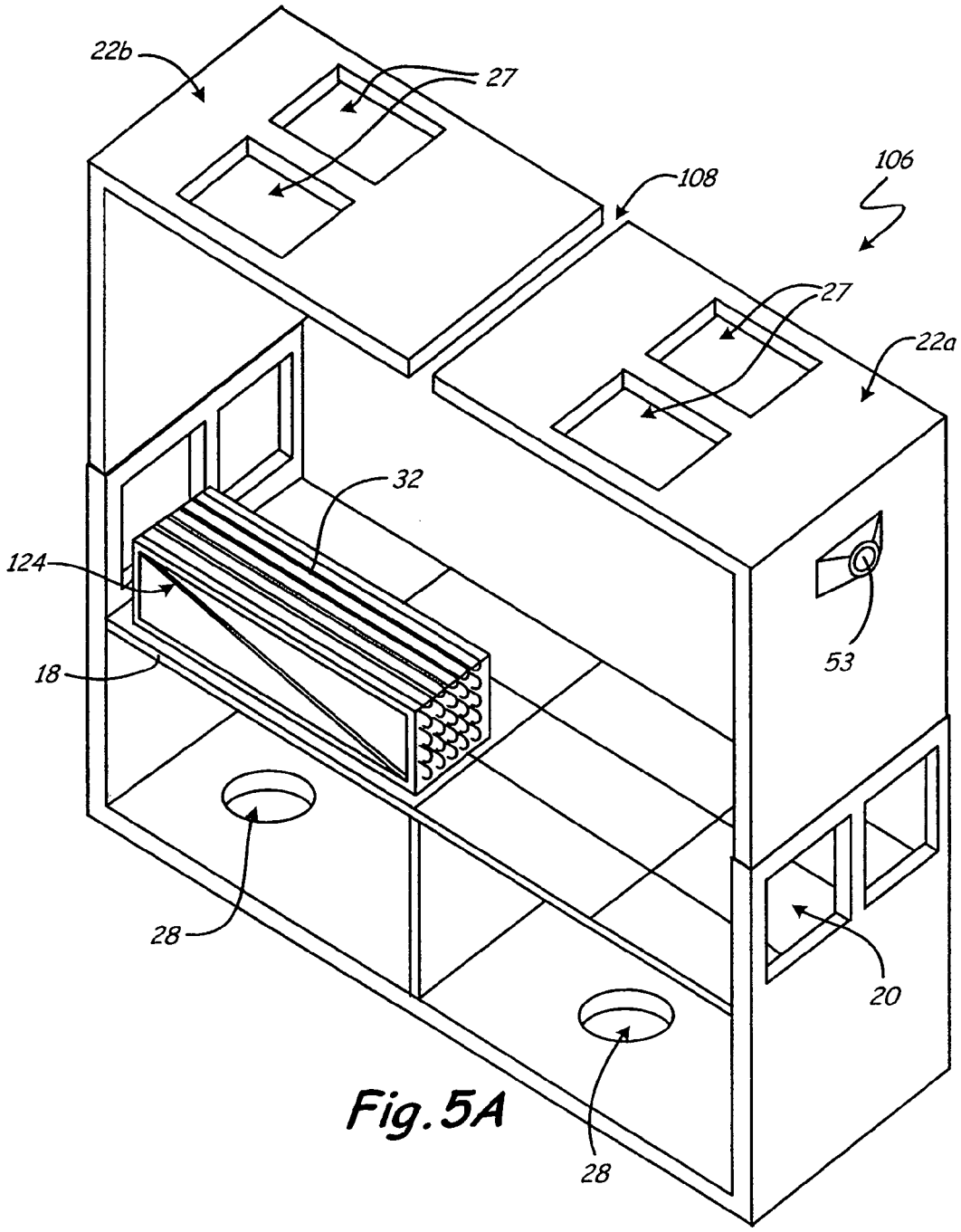
FIG. 5A is a view illustrating a fluidized bed module.

FIG. 5A illustrates an embodiment of one dryer module 106. Dryer module includes upper housing sections 22*a* and 22*b*, each with apertures 27 and bypass gas inlet 53, middle housing section 20 with bed heat exchanger 32, distribution plate 18 and plenum section 16 with gas inlets 28. FIG. 5A illustrates dryer module 106 with bed heat exchanger 32. As discussed above, bed heat exchanger 32 is optional and not necessary in those configurations where the fluidizing gas itself carries enough thermal energy to dry the fluidized coal in fluidized bed dryer 12. In these cases, bed heat exchanger 32 can be omitted from dryer module 106. Dryer modules 106 are designed to be placed side-by-side and welded together to form fluidized bed dryer 12 (shown in FIG. 6). Adjacent dryer modules 106 are arranged so that a right edge of upper housing section 22 of a first module 106 abuts a left edge of upper housing section 22 of a second module 106. The same arrangement applies for right and left edges of middle housing sections 20 and plenum sections 16. Once arranged, dryer modules 106 are bolted and welded together. Adjacent modules are bolted together to ensure proper alignment, then seal welded together to form a gastight seal between adjacent dryer modules 106. The welded modules 106 create a continuous fluidized bed dryer 12 extending from the first module to the last. To complete fluidized bed dryer 12, an end cap module (not shown) is welded to the outside ends of the first and last modules. One end cap module typically includes one or more coal outlets 26 to remove coal from fluidized bed dryer 12. Dryer modules 106 can be identical, having plenum sections 16, middle housing sections 20 and upper housing sections 22 with identical dimensions and identical placement of distribution plates 18, apertures 27, gas inlets 28 and bypass gas inlets 53.

Upper housing section 22 can include gap 108 between sections 22*a* and 22*b*. Due to the dimensions of fluidized bed dryer 12 and dryer modules 106 and the weight of construction materials used in their construction, additional support structures may be required. In these instances, gap 108 separates upper housing sections 22*a* and 22*b* so that support bar 110 (shown in FIG. 6) can be welded to sections 22*a* and 22*b* to provide additional support to fluidized bed dryer 12. Each upper housing section (22*a* and 22*b*) shown in FIG. 5A also includes two apertures 27. Apertures 27 are configured to serve as coal inlets 24 or gas outlets 30, depending on need. Apertures 27 are all generally the same size, and can be easily modified to incorporate coal inlet 24 structures (airlock, etc.) or gas outlet 30 structures (nozzle, etc.). Typically, coal is introduced into fluidized bed dryer 12 from about one to four coal inlets 24, depending on the overall size of dryer 12. Thus, only one to four dryer modules 106 need open apertures 27 serving as coal inlets 24. When one or both apertures 27 are not used as coal inlets 24 to deposit coal into fluidized bed dryer 12, apertures 27 are sealed off or used as exhaust gas outlets (gas outlet 30). Having apertures 27 in each dryer module 106 allows for flexibility when assembling fluidized bed dryer 12 (i.e. design changes can be made during the final stages of assembly, if required). Bypass gas from bypass gas loop 52 enters fluidized bed dryer 12 through bypass gas inlets 53. Each dryer module 106 typically has two bypass gas inlets 53, one on each side of dryer module 106 (only one is visible in FIG. 5A). Bypass gas inlets 53 can be sealed off in locations where bypass gas is not needed to reduce the humidity within fluidized bed dryer 12.

Figure 5B:
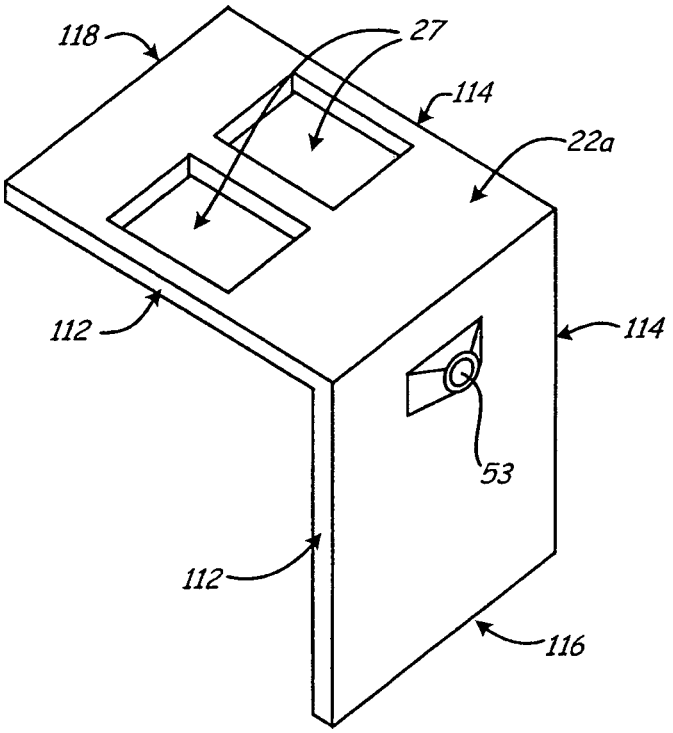
FIG. 5B is a view illustrating part of an upper section of the module of FIG. 5A.

FIG. 5B illustrates upper housing section 22*a* of FIG. 5A. Upper housing section 22*a* can be constructed as shown and shipped to the installation site for final assembly. Due to their L-shaped configuration, multiple upper housing sections 22 can be nested together and shipped at once. Nesting the sections and shipping them together helps reduce transportation costs. Upper housing section 22*a* includes left edge 112, right edge 114, bottom edge 116 and center edge 118. During assembly at the installation site, welds are made along edges 112, 114, 116 and 118. FIG. 5E illustrates the areas (hatched surfaces) where welding is performed on dryer module 106. For example, left edge 112 of upper housing section 22*a* is welded to an end cap module while right edge 114 is welded to the left edge of an adjacent module's upper housing section 22. Bottom edge 116 is welded to middle housing section 20. Center edge 118 is welded to support bar 110.

Figure 5C:
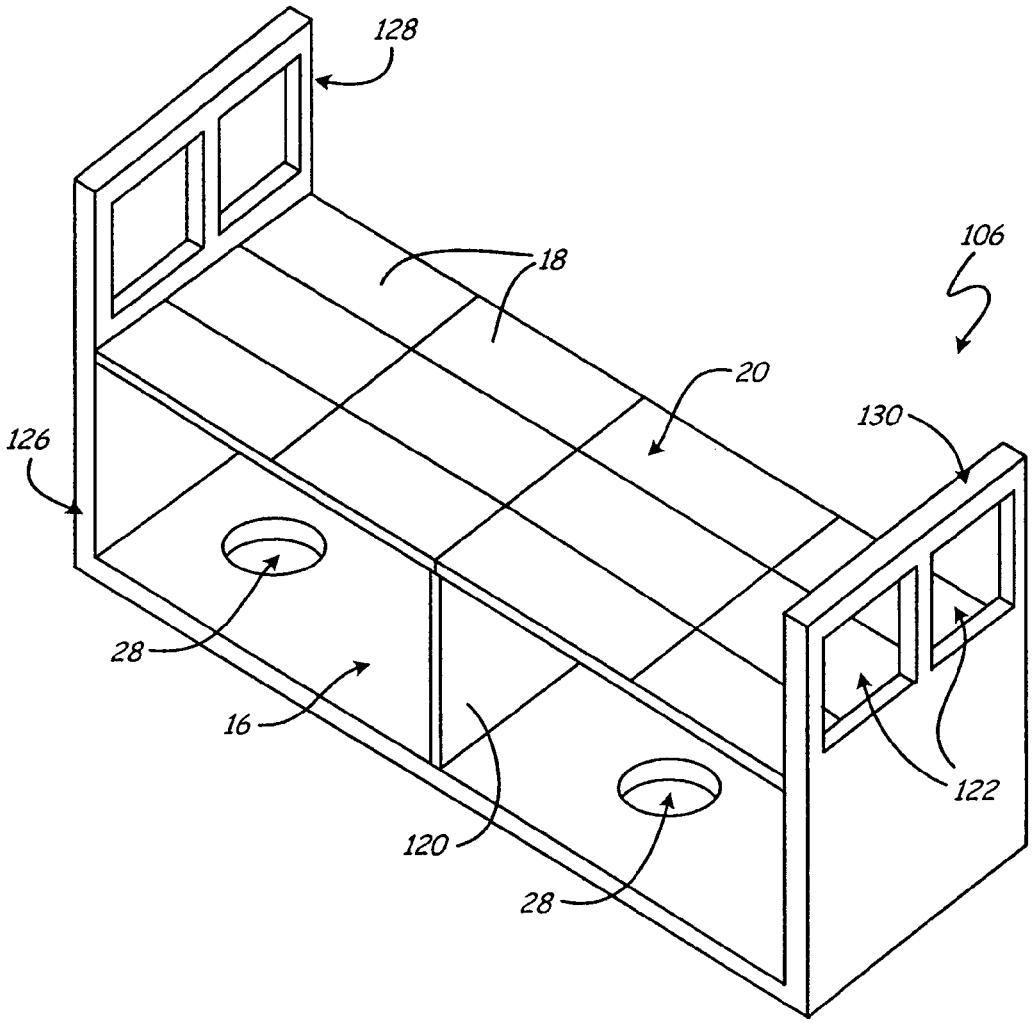
FIG. 5C is a view illustrating a lower section of the module of FIG. 5A.

FIG. 5C illustrates plenum section 16, distribution plate 18 and middle housing section 20 of dryer module 106 shown in FIG. 5A. Plenum section 16 is compartmentalized. One or more walls 120 divide plenum section 16 into two or more compartments. Each compartment includes gas inlet 28. Plenum section 16 in FIG. 5C has four compartments and four gas inlets 28 (distribution plate 18 obscures two compartments and two gas inlets). Distribution plate 18 can be one singe plate or a network of smaller plates assembled together as shown in FIG. 5C.

Middle housing section 20 includes apertures 122, which allow for easy installation and removal of bed heat exchangers 32. Easy installation and removal of bed heat exchangers 32 is useful as fluidized bed dryer 12 can operate with or without bed heat exchangers 32 in middle housing section 20. Bed heat exchangers 32 are not shown in dryer module 106 in FIG. 5C, but are present in FIG. 5D. In one embodiment, middle housing section 20 includes one or more tracks and rollers so that bed heat exchangers 32 can roll into or out of their positions within dryer module 106 and fluidized bed dryer 12. Track system 124 (shown in FIG. 5D) can include multiple tracks supported above distribution plate 18. Support for track system 124 can be provided by middle housing section 20 and supports extending from the tracks to the top of wall 120 in plenum section 16. Bed heat exchangers 32 are equipped with or connected to rollers that engage with the track so that bed heat exchangers 32 can be rolled along the track into and out of position within fluidized bed dryer 12. For example, track system 124 can have two tracks and bed heat exchanger 32 can have four rollers. More tracks and/or rollers can also be used. The rollers can be part of bed heat exchanger 32 or part of track system 124 (and allow bed heat exchanger 32 to roll onto track system 124). Bed heat exchanger 32 and track system 124 can be configured so that bed heat exchanger 32 rolls into and out of fluidized bed dryer 12 like a drawer. Bed heat exchanger 32 can also engage with track system 124 so that it hangs from the tracks of track system 124. Track system 124 can include additional support mechanisms so that the rollers are not engaged with track system 124 or bed heat exchanger 32 when bed heat exchanger 32 is in place within fluidized bed dryer 12. This will reduce the stress and wear placed upon the tracks and rollers. Track system 124 allows bed heat exchangers 32 to be more easily removed from fluidized bed dryer 12 for repair or replacement. This allows for easier and safer access to bed heat exchangers 32.

Plenum section 16 and middle housing section 20 include left edge 126 and right edge 128. Middle housing section 20 also includes top edge 130. As is the case with upper housing section 22, welds are made along edges 126, 128 and 130 during assembly of fluidized bed dryer 12 at the installation site. For example, left edge 126 of plenum section 16 is welded to an end cap module while right edge 128 is welded to the left edge of an adjacent module's plenum section 16. Left edge 126 of middle housing section 20 is welded to an end cap module while right edge 128 is welded to the left edge of an adjacent module's middle housing section 20. Top edges 116 of middle housing section 20 are welded to bottom edges 116 of upper housing sections 22*a* and 22*b*.

Figure 5D:
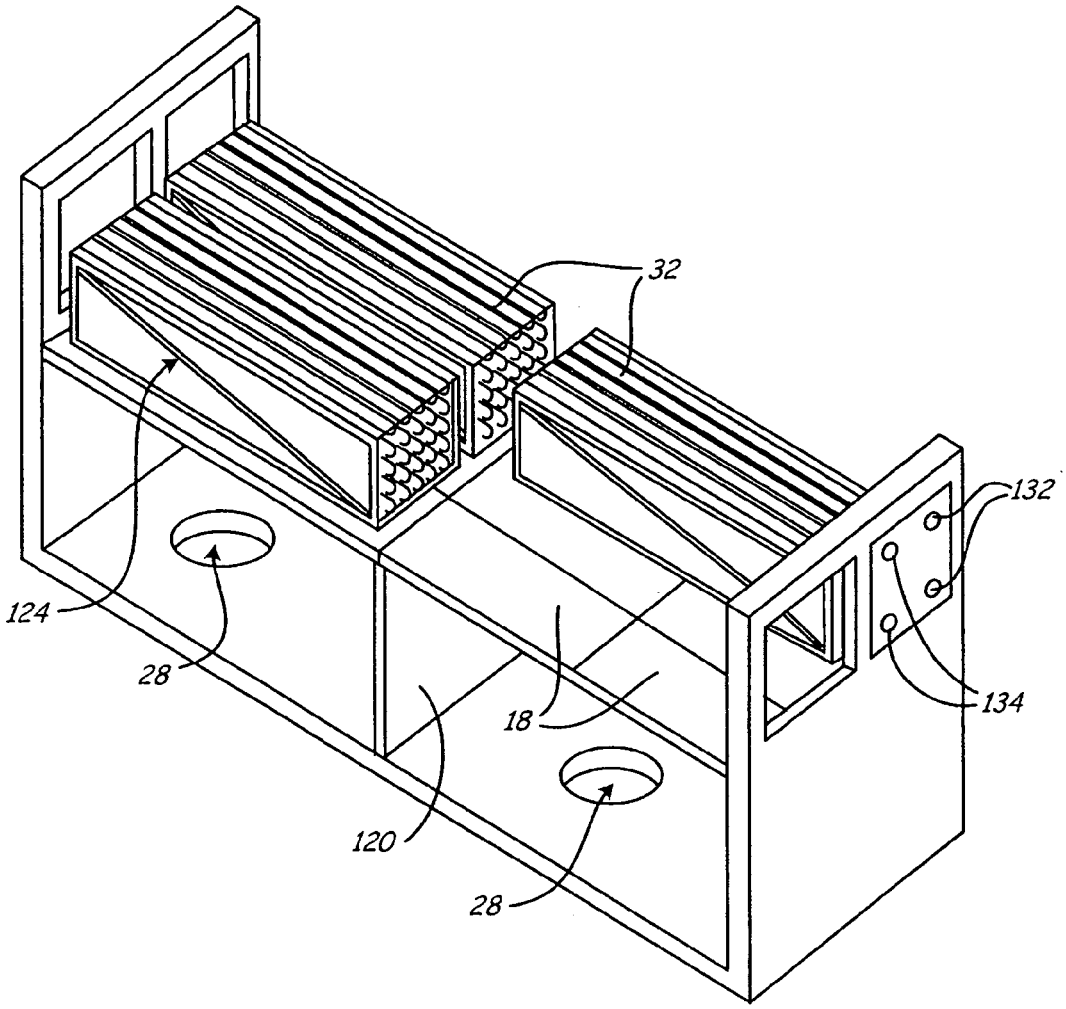
FIG. 5D is a view illustrating the lower section of the module of FIG. 5C with heat exchangers.
Figure 5E:
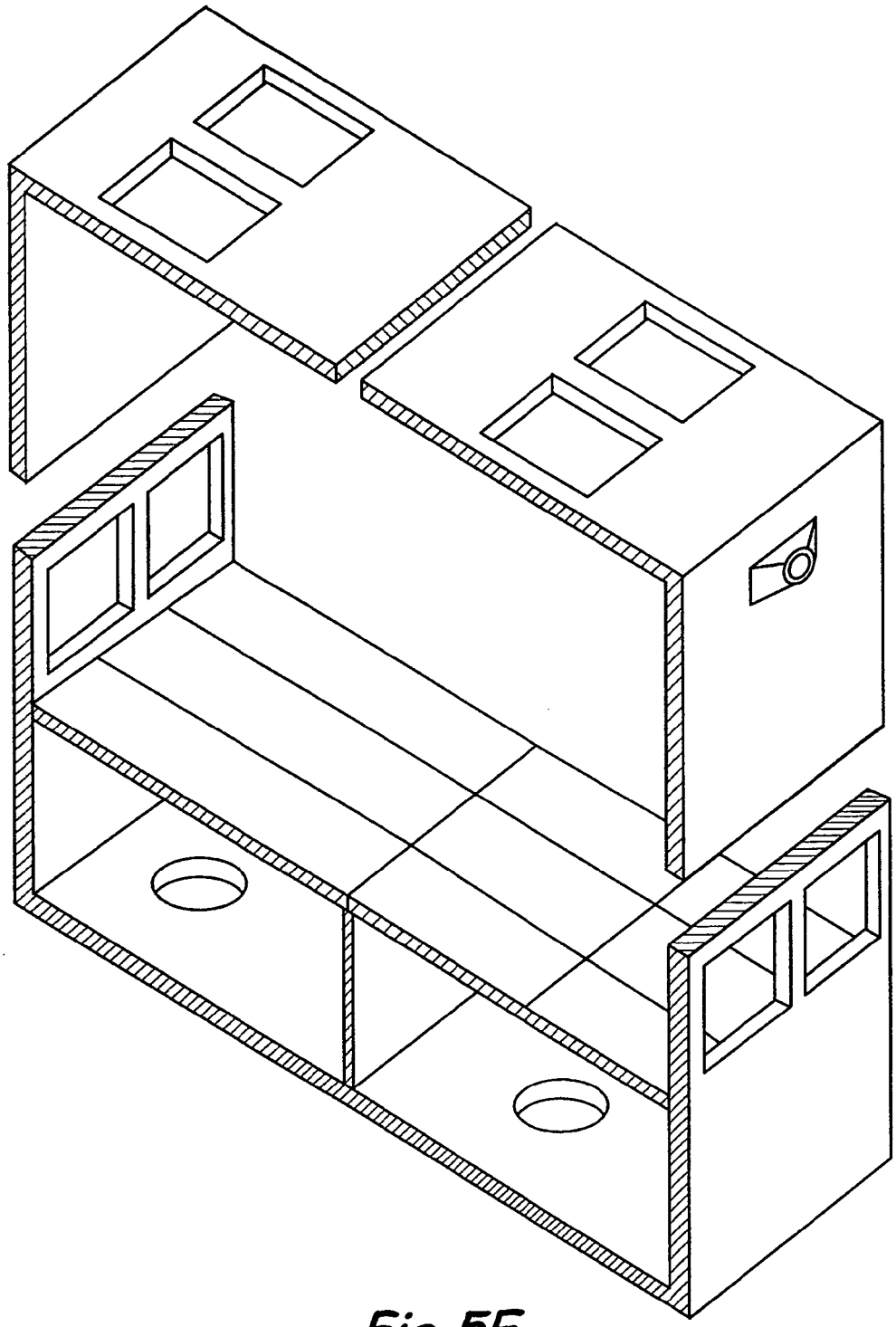
FIG. 5E is a view illustrating the welding points of the module of FIG. 5A.

FIG. 5D illustrates plenum section 16 and middle housing section 20 of dryer module 106 with bed heat exchangers 32 in place in track system 124 within middle housing section 20. Bed heat exchangers 32 include fluid inlets 132 and outlets 134 which allow heat transfer fluid to enter and exit, respectively, bed heat exchangers 32. Bed heat exchangers 32 are removed from middle housing section 20 below coal inlets 24 to prevent damage to the heating tubes, plates or coils of bed heat exchangers 32. The bottom left portion of middle housing section 20 illustrates an example above which coal inlet 24 can be placed.

Figure 6:
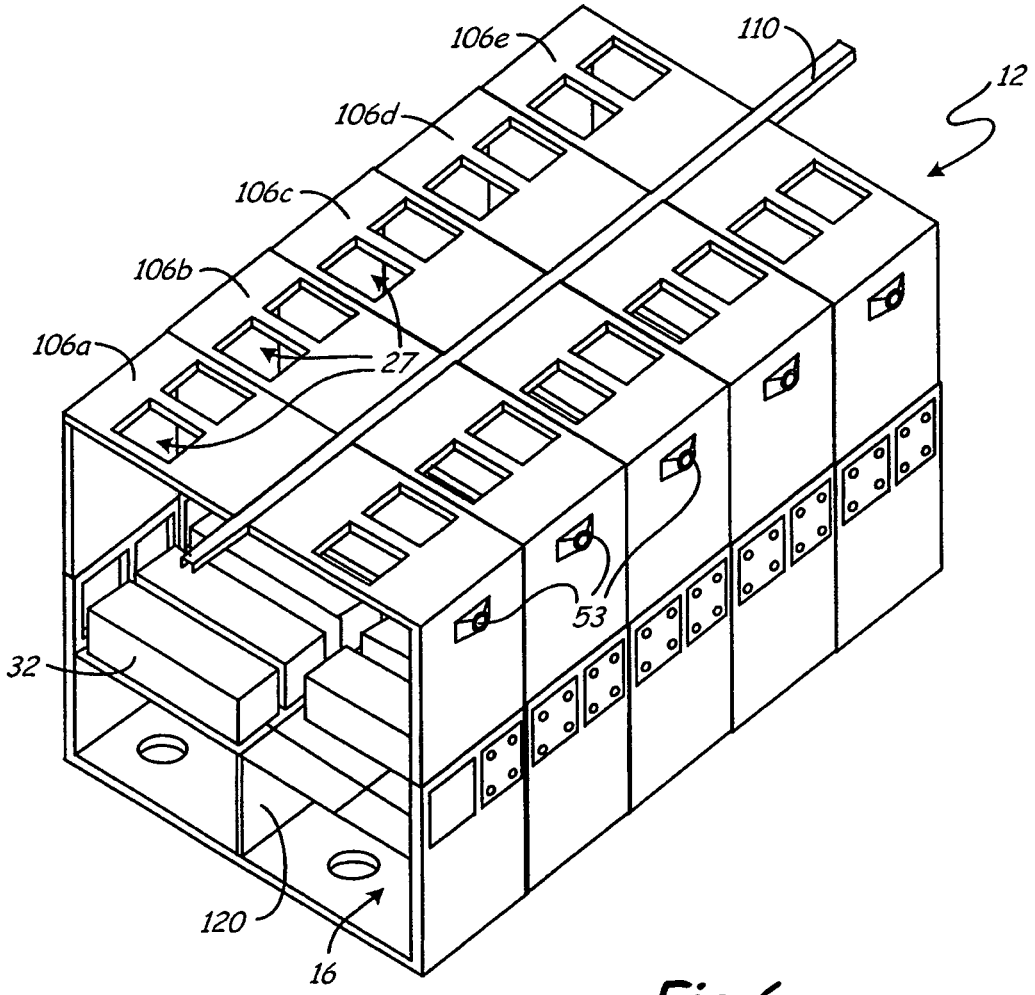
FIG. 6 is a view illustrating a modular fluidized bed dryer.

FIG. 6 illustrates a nearly complete fluidized bed dryer 12. The end cap has been omitted to show the inside of fluidized bed dryer 12. Fluidized bed dryer 12 contains five dryer modules 106*a*-106*e* aligned side-by-side and welded together to seal dryer 12 so that it is gas tight. Fluidized bed dryer 12 can contain five, ten, twenty or more modules depending on the needs of coal drying system 10. Support bar 110 extends the length of fluidized bed dryer 12. Vertical supports extend from support bar 110 down to wall 120 of plenum section 16 to provide additional support. All five modules 106 are identical. Since modules 106 contain more apertures 27 than are necessary for coal inlets 24 and gas outlets 30 for operation, unused apertures 27 will be sealed. Modules 106 provide additional flexibility for configuring where coal inlets 24 and gas outlets 30 will be located. Last minute changes to the location of coal transport lines or gas ducting lines can be made, if necessary. Modules 106 can be adapted to fit these kinds of modifications.

The present invention provides a particulate matter drying system and a method for drying particulate matter. The drying system and method take advantage of a closed loop drying design to dry particulate matter, such as coal, safely and efficiently. Wet particulate matter is fluidized in a dryer with a fluidizing gas to transfer moisture from the particulate matter to the fluidizing gas. Fine particles and water vapor are removed from the fluidizing gas so it can be recycled and reused to fluidize and dry additional particulate matter. Oxygen control features prevent oxygen from entering the drying system to reduce the potential for spontaneous combustion when particulate matter like coal is dried. According to the present invention, particulate matter can be dried efficiently using a closed loop system while maintaining strict control over the amount of oxygen present in the system. The present invention also provides a modular drying system. Dryer modules can be constructed at a site different from the installation site, shipped to the installation site and assembled to complete the drying system. The system modularity allows skilled manufacturers to produce the modules at a manufacturing site with its own equipment without having to travel to the installation site. This allows for a higher quality product and consistent system builds. Earlier drying systems do not possess all of these capabilities.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the appended claims.

The invention claimed is:

1. A method for drying particulate matter, the method comprising:

delivering particulate matter to a dryer;

heating a fluidizing gas in a heat exchanger located outside the dryer;

delivering a first portion of heated fluidizing gas through the dryer to fluidize the particulate matter;

heating the particulate matter in the dryer with the first portion of fluidizing gas to a temperature between about 15° C. and about 200° C. to remove water from the particulate matter;

further heating a second portion of heated fluidizing gas;

delivering the second portion of heated fluidizing gas to an upper portion of the dryer to control humidity within the upper portion of the dryer;

removing water vapor and fluidizing gas from the dryer;

removing fine particulates from the fluidizing gas removed from the dryer;

removing water vapor from the fluidizing gas removed from the dryer;

after removing fine particulates and water vapor from the fluidizing gas removed from the dryer, redirecting the removed fluidizing gas back to the dryer; and removing dried particulate matter from the dryer.

2. The method of claim 1, wherein fine particulates removed from the fluidizing gas is combined with dried particulate matter removed from the dryer.

3. The method of claim 1, wherein removal of a kilogram of water from the particulate matter requires between about 2740 kJ and about 3260 kJ of thermal energy.

4. The method of claim 1, wherein the particulate matter is coal.

5. The method of claim 4, wherein the coal is delivered to the dryer via an airlock, and wherein the airlock is purged with an inert gas during coal deposit to prevent ingress of oxygen into the dryer.

6. The method of claim 4, wherein the coal is removed from the dryer via an airlock, and wherein the airlock is purged with an inert gas during coal removal to prevent ingress of oxygen into the dryer.

7. The method of claim 4, further comprising:

heating the coal using a heat exchanger located in the dryer.

8. The method of claim 4, wherein the coal is heated in the dryer using a waste heat source.

9. The method of claim 4, wherein the coal and the first portion of fluidizing gas is heated in the dryer to between about 15° C. and about 120° C.

10. The method of claim 4, wherein the dried coal has an average particle size diameter less than about 50% of an average particle size diameter of the coal deposited into the dryer.

11. The method of claim 1, wherein a volume ratio of the first portion of heated fluidizing gas to the second portion of heated fluidizing gas is about 4:1.

12. A method for controlling oxygen content in a closed loop coal drying system, the method comprising:

depositing coal into a fluidized bed dryer via a coal inlet airlock and purging the coal inlet airlock with an inert gas during coal deposit to prevent ingress of oxygen into the fluidized bed dryer;

circulating a first portion of heated fluidizing gas through the fluidized bed dryer to remove water vapor from the coal;

further heating a second portion of heated fluidizing gas and delivering the second portion of heated fluidizing gas to an upper portion of the dryer to control humidity within the upper portion of the dryer;

removing water vapor and fluidizing gas from the fluidized bed dryer;

removing particulate material from the fluidizing gas with a dust collector, wherein inert gas is directed at the dust collector to prevent ingress of oxygen into the dust collector;

removing water vapor from the fluidizing gas with a condenser;

redirecting the fluidizing gas to the fluidized bed dryer after removing water vapor from the fluidizing gas with a fan having at least one seal, wherein inert gas is directed at the at least one seal to prevent ingress of oxygen; and removing dried coal from the fluidized bed dryer via a coal outlet airlock and purging the coal outlet airlock with an inert gas during coal removal to prevent ingress of oxygen into the fluidized bed dryer.

13. The method of claim 12, further comprising heating the second portion of fluidizing gas to a higher temperature than the first portion of fluidizing gas.

14. A coal drying system comprising:

a fluidized bed dryer comprising:

a coal inlet for delivering coal to the fluidized bed dryer, wherein the coal inlet transfers coal into the fluidized bed dryer and receives an inert gas during transfer to prevent ingress of oxygen into the fluidized bed dryer;

a gas inlet for receiving a fluidizing gas;

a heat exchanger for heating coal and fluidizing gas in the fluidized bed dryer;

a gas outlet for removing water vapor and fluidizing gas; and a coal outlet for removing coal from the fluidized bed dryer, wherein the coal outlet transfers coal out of the fluidized bed dryer and receives an inert gas during transfer to prevent ingress of oxygen into the fluidized bed dryer; and a fluidizing gas loop in fluid communication with the fluidized bed dryer comprising:

a first heat exchanger for heating the fluidizing gas;

a second heat exchanger for further heating a portion of the fluidizing gas;

a bypass for directing fluidizing gas that has passed through the second heat exchanger to an upper portion of the fluidized bed dryer;

a dust collector for removing fine particulates from the fluidizing gas after the fluidizing gas has exited the fluidized bed dryer;

a condenser for removing moisture from the fluidizing gas;

a fan for circulating fluidizing gas through the fluidizing gas loop, wherein the fan has a seal and an inert gas is directed at the seal to prevent ingress of oxygen into the fluidizing gas loop;

a vent outlet for removing gas from the fluidizing gas loop; and a makeup gas inlet for adding fluidizing gas to the fluidizing gas loop.

15. The system of claim 14, wherein the fluidized bed dryer further comprises:

a baffle located between the gas inlet and the gas outlet, wherein the baffle creates different zones within the fluidized bed dryer.

16. The system of claim 15, further comprising:

a plurality of dampers configured to regulate the flow of fluidizing gas into each section of the fluidized bed dryer.

17. The system of claim 14, further comprising:

sensors for monitoring oxygen content and carbon monoxide content in the fluidizing gas.

18. The system of claim 14, further comprising:

a pressure sensor for monitoring pressure within the fluidized bed dryer.

19. The system of claim 14, further comprising:

a humidity sensor for monitoring a relative humidity of the fluidizing gas.

20. The system of claim 14, further comprising:

a sight glass for observing contents of the fluidized bed dryer.

21. The system of claim 14, wherein the heat exchanger in the fluidized bed dryer and the heat exchanger in the fluidizing gas loop receive thermal energy from a waste heat source.

* * * * *